US005824935A

United States Patent [19]

Tanaka

[11] Patent Number: 5,824,935

[45] Date of Patent: Oct. 20, 1998

[54] MUSIC APPARATUS FOR INDEPENDENTLY PRODUCING MULTIPLE CHORUS PARTS THROUGH SINGLE CHANNEL

[75] Inventor: Takahiro Tanaka, Hamamamtsu, Japan

[73] Assignee: Yamaha Corporation, Hamamatsu, Japan

[21] Appl. No.: 904,409

[22] Filed: Jul. 31, 1997

[30] Foreign Application Priority Data

Aug. 6, 1996 [JP] Japan ..... 8-233067

[51] Int. Cl.[6] ..... G10H 1/10; G10H 7/00

[52] U.S. Cl. ..... 84/631; 84/645

[58] Field of Search ..... 84/616, 619, 631, 84/645, 654, 657, 664

[56] References Cited

U.S. PATENT DOCUMENTS

| | | | |
|---|---|---|---|
| 5,286,907 | 2/1994 | Okamura et al. | 434/307 A |
| 5,294,746 | 3/1994 | Tsumura et al. | 434/307 A |
| 5,499,922 | 3/1996 | Umeda et al. | 434/307 A |
| 5,521,326 | 5/1996 | Sone | 84/631 |

*Primary Examiner*—Brian Sircus
*Assistant Examiner*—Jeffrey W. Donels
*Attorney, Agent, or Firm*—Pillsbury Madison & Sutro LLP

[57] ABSTRACT

In a music apparatus, a generator device has a plurality of channels for concurrently generating various tones. At least, one channel is assigned to generate chorus tones belonging to a multiple of melody parts arranged in parallel to each other. A provider device provides music messages assigned to the plurality of the channels to generate the various tones. The music messages includes a particular music message being assigned to the one channel and being composed of a first music message which contains a note and identifies a melody part to which the note belongs, and a second music message which contains a parameter and identifies a melody part to which the parameter belongs. A controller device controls the one channel of the generator device according to the note and the parameter both belonging to the same melody part so as to generate the chorus tone such that the one channel can generate a chorus tone belonging to a melody part independently from another chorus tone belonging to another melody part.

14 Claims, 6 Drawing Sheets

MUSIC APPARATUS FOR INDEPENDENTLY PRODUCING MULTIPLE CHORUS PARTS THROUGH SINGLE CHANNEL

BACKGROUND OF THE INVENTION

1. Field of the Invention

The present invention generally relates to a music apparatus such as a karaoke apparatus for generating music tones through MIDI (Musical Instrument Digital Interface). More particularly, the invention relates to a music apparatus having an improved capability of processing chorus tones.

2. Description of Related Art

Conventionally, a karaoke apparatus which is a typical example of a music apparatus reproduces music tones by reading a magnetic tape on which the music tone is recorded as an analog audio signal. With the advance in electronics technology, the magnetic tape is replaced by a CD (Compact Disk) or an LD (Laser Disk). The audio signal to be recorded is changed from analog to digital. The digital data recorded on these disks is not only music data but also a variety of other items of data including image data and lyrics data.

Recently, communication-type karaoke apparatuses are quickly gaining popularity, in which, instead of using the CD or the LD, music data and other karaoke data are captured through a communication line such as a general telephone line or an ISDN line. The captured data is processed through a tone generator and a sequencer. These communication-type karaoke apparatuses include a non-storage type in which music data to be reproduced is delivered every time the reproduction is requested, and a storage-type in which captured music data is stored in an internal storage device such as a hard disk and read out for reproduction upon request. Currently, the storage-type karaoke apparatus is dominating the karaoke market mainly because of its lower communication cost. The state-of-the-art data compression technology and the communication technology are introduced into the communication-type karaoke apparatuses so as to reduce the amount of data for each piece of music, thereby minimizing the communication time or communication cost and the internal storage capacity.

These days, a developed karaoke apparatus is constituted to impart chorus tones of a harmony part to live singing voice of a karaoke player for interesting karaoke performance. In such a karaoke apparatus, an internal storage provisionally stores main melody data representing a main melody line to be sung by a karaoke player and chorus melody data for synthesizing chorus tones of a harmony melody part in consonant with the main melody line. Based on a pitch difference between these main melody data and the chorus melody data, the pitch of the singing voice of a karaoke player is shifted to generate the chorus tone of the harmony melody part or chorus part. This chorus tone is vocalized concurrently with the singing voice of the karaoke player to attach a predetermined harmony melody part in a virtual manner. By providing plural lines of the chorus melody data, chorus tones of multiple harmony melody parts can be generated for a plurality of karaoke players.

However, the above-mentioned karaoke apparatus concurrently processes chorus tones of two to four harmony melody parts by one MIDI channel, so that localization (pan pot) control cannot be performed independently on the respective parts. Also, pitch bend control and the like cannot be performed independently on the respective harmony melody parts. To be more specific, as shown in FIG. 2, the chorus melody data is composed of a first part PART1 through a fourth part PART4. The chorus melody data composed of these four parts is assigned to one MIDI channel to be handled as one set shown in FIG. 3. This prior art disables localization control on the respective chorus tones of the first part PART1 through the fourth part PART4 in different manners, and disables independent assignment of pitch bend to these parts. It should be noted that the chorus melody data including these four parts could be divided by parts, and the resultant pieces of data could be assigned to different MIDI channels, thereby controlling the assigned chorus melody data independently of each other. Such a setup, however, increases the number of independent harmony melody parts, which in turn increases the number of MIDI channels to be assigned to the chorus melody data. Consequently, some of 16 to 32 MIDI channels are occupied for generation of the chorus tones, which in turn may cause deficiency of available channels to be assigned to other musical tones, thereby imposing restrictions on performance of the music apparatus.

SUMMARY OF THE INVENTION

It is therefore an object of the present invention to provide a music apparatus for achieving localization (pan pot) control on chorus tones of a plurality of harmony melody parts independently of each other and for assigning independent effects such as pitch bend to these plurality of harmony melody parts without increasing undue occupancy of the MIDI channels.

In carrying out the invention and according to one aspect thereof, there is provided a music apparatus in which melody line data of a plurality of parts are mixedly assigned to one MIDI channel. An absolute pitch of the melody line data in each part is encoded in advance into a relative pitch indicating a pitch difference between the absolute pitch and a reference pitch set to each part. The resultant pitch difference data is then decoded into the absolute pitch data within a predetermined pitch range. Based on this conversion, an extended MIDI message corresponding to each part is prepared. According to the prepared MIDI message, a different effect and a different localization are independently provided for each part to reproduce the chorus tone. A karaoke apparatus having the abovementioned music apparatus can vocalize the chorus tones of harmony melody parts based on the melody line data independently of each other.

A plurality of parts of melody line data are assigned to one MIDI channel ,and the chorus tones of the harmony melody parts are concurrently generated by these melody line data. Localization (pan pot) control and pitch bend control can be provided for each part independently without using a plurality of MIDI channels. The inventive apparatus converts the absolute pitch of the melody line data in each part into the relative pitch data representing the pitch difference between the absolute pitch and a reference pitch set to each part. The melody line data of each part constitutes a chorus tone. Generally, an interval or pitch range in which a natural human voice dynamically changes along one melody line is narrower than that of a musical instrument. Consequently, by obtaining the pitch difference between the reference pitch set to each part and the absolute pitch of each melody line data, the absolute pitch of the melody line data in each part is once converted into the relative pitch data representing the pitch difference between the absolute pitch and the reference pitch set to each part. In the present invention, the resultant pitch difference data is utilized to prepare an extended MIDI message corresponding to each part. In an ordinary MIDI message, the pitch data of one note has seven bits length representing 128 pitches in a unit of semitone. According to the present invention, the pitch difference data or relative pitch data is represented by lower five bits of these seven bits, and part identification data "00", "01", "10", and "11" are assigned to highorder two bits to formulate the extended MIDI message corresponding to each part. In other words, in the present invention, the pitch data of the melody line data of each part is set such that the pitch data falls within one of pitch ranges "00 through 31", "32 through 63", "64 through 95", and "96 through 127" in note number. The determination of these pitch ranges can be appropriately altered according to the number of harmony melody parts.

The extended MIDI message thus generated inherits the conventional MIDI message format, so that the MIDI message according to the invention can be edited for example by a commercially available sequencer or the like. The music apparatus operates according to the MIDI message thus generated to impart different effects and different localization to each part. The above-mentioned novel setup allows localization (pan pot) control and effect control such as pitch bend to be provided independently to a plurality of chorus melody data without increasing undue occupancy of MIDI channels.

In carrying out the invention and according to another aspect thereof, control information for setting or changing the tone control is supplied in combination with channel information indicating a channel for which the setting or changing is to be made. At the same time, pitch information designating a pitch of a chorus tone to be generated is supplied in combination with the above-mentioned channel information. Characterizingly, part information identifying a particular one of a plurality of melody parts is attached to the above-mentioned control information. Also, part information identifying a particular one of the plurality of melody parts is attached to the above-mentioned pitch information. Each of the melody parts is identified by a combination of the channel information and the part information contained in the supplied MIDI message. According to the control information and the pitch information for each identified melody part, a desired chorus tone is reproduced for each melody part. The control information attached with the above-mentioned part information includes information indicating a reference pitch allotted to a corresponding melody part indicated by the part information. The pitch information attached with the same part information is composed of information indicating a relative pitch with respect to the reference pitch. When a chorus tone is reproduced, the relative pitch is restored to an absolute pitch from the above-mentioned control information and the pitch information for each melody part.

In carrying out the invention and according to still another aspect thereof, a first music message is supplied which is a combination of control information for setting or altering the tone control and channel information for indicating a channel subject to the control. In addition, a second music message is supplied which is a combination of pitch information designating a pitch of a tone to be performed and the above-mentioned channel information. By the combination of these first and second music messages, performance information corresponding to a given piece of music is provided. In the first message, part information indicating one of a plurality of melody parts is attached to the above-mentioned control information. In the second message, part information indicating one of a plurality of melody parts is attached to the above-mentioned pitch information. The combination of the first and second music messages for the above-mentioned given piece of music is stored in a storage media. Moreover, the above-mentioned first and second music messages are received by the music apparatus. Based on the variety of information included in the received messages, the music tones controlled independently for each channel are reproduced. If any of the music messages includes the above-mentioned part information, each melody part is identified by a combination of this part information and the channel information. A desired tone is reproduced for the identified melody part according to the control information and the pitch information.

The above and other objects, features and advantages of the present invention will become more apparent from the accompanying drawings, in which like reference numerals are used to identify the same or similar parts in several views.

DETAILED DESCRIPTION OF PREFERRED EMBODIMENTS

Figure 4:
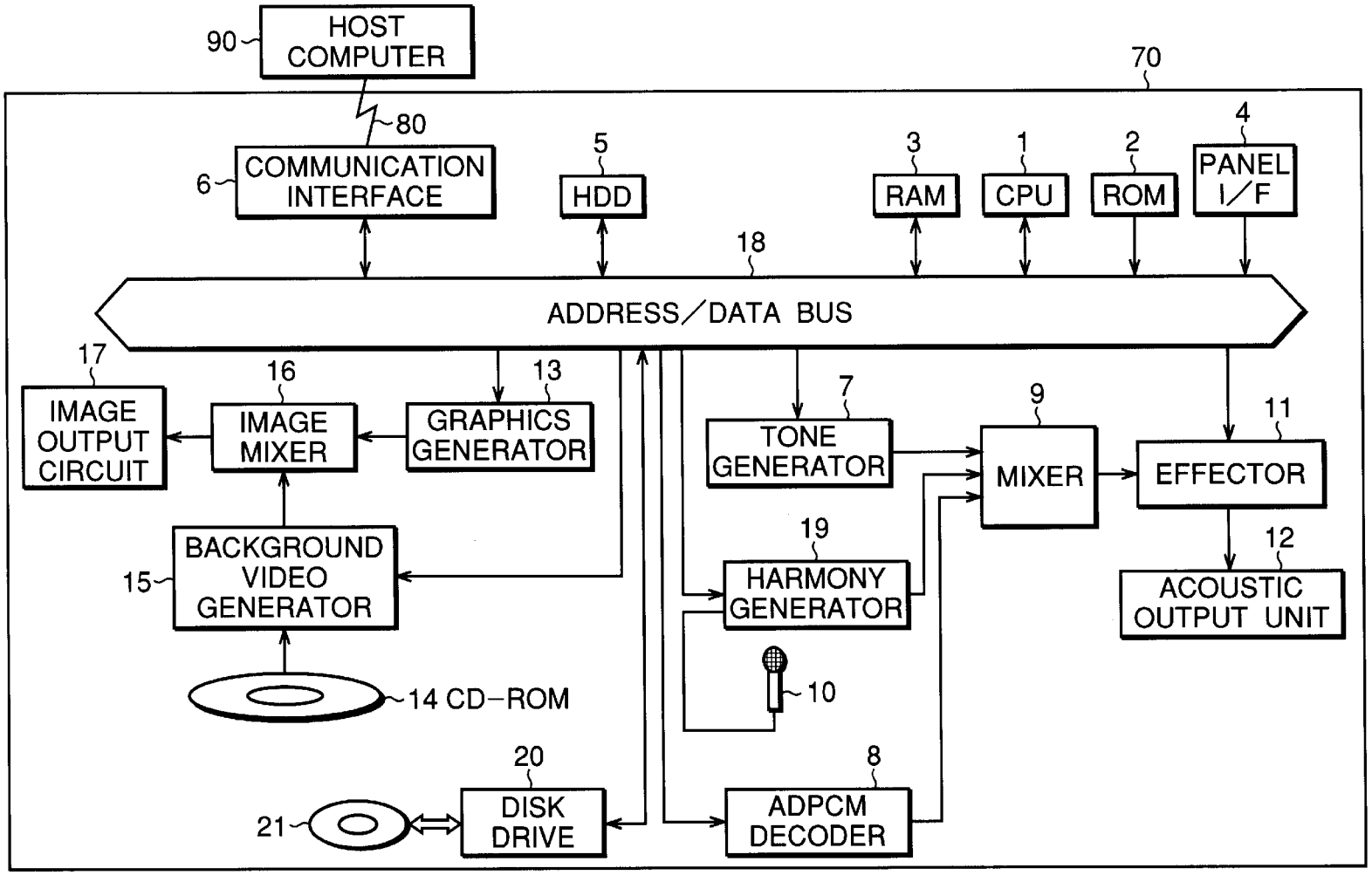
FIG. 4 is a general block diagram illustrating an overall constitution of a karaoke apparatus practiced as one preferred embodiment of the present invention.

This invention will be described in further detail by way of example with reference to the accompanying drawings. Now, referring to FIG. 4, there is shown a general block diagram illustrating an overall constitution of a karaoke apparatus practiced as one preferred embodiment of a music apparatus associated with the present invention. In the above-mentioned preferred embodiment, a karaoke apparatus 70 is connected to a host computer 90 through a communication interface 6 and a communication network 80. The karaoke apparatus 70 is of a storage type that receives music data distributed from the host computer 90 and that stores the received music data in an incorporated hard disk drive (HDD) 5.

The karaoke apparatus 70 is adapted to perform a variety of operations under the control of a microcomputer system composed of a microprocessor unit (CPU) 1, a program memory (ROM) 2, and a working memory (RAM) 3. The CPU 1 controls the operations of the entire karaoke apparatus 70. The CPU 1 is connected through an address/data bus 18 to the program memory (ROM) 2, the working memory (RAM) 3, a panel interface 4, a hard disk drive (HDD) 5, a tone generator 7, an ADPCM decoder 8, an effector 11, a graphics generator 13, a background video generator 15, and a harmony generator 19. It should be noted that, in addition to the above-mentioned components, a MIDI interface circuit and a background image reproducing apparatus composed of an LD changer or a CD changer are connected to the CPU 1. Further, a disk drive 20 is connected to the busl8 for receiving a machine readable media 21 such as a floppy disk or a compact disk which contains music messages. The media 21 is loaded into the disk drive 20 to provide the music message if the same is not stored in the HDD 5.

The program memory 2 composed of a read-only memory (ROM) stores system programs to be executed by the CPU 1, a boot program for loading the system programs stored in the hard disk drive 5, and a variety of parameters and data. The working memory 3 composed of a random access memory (RAM) temporarily stores a system program loaded from the hard disk drive 5 and a variety of data generated during the course of program execution by the CPU 1. A predetermined area in the RAM is used for a register or a flag.

The panel interface 4 converts a command signal coming from a variety of controls arranged on a panel (not shown) of the karaoke apparatus 70 and a command signal coming from a remote commander (not shown), into signals that can be processed by the CPU 1, and outputs the converted signals to the address/data bus 18.

The hard disk drive 5 stores the system programs and music data of the karaoke apparatus 70, and has a storage capacity of several hundred megabytes to several gigabytes, for example. In the above-mentioned preferred embodiment, vocal data included in the music data stored in the hard disk drive 5 is compressed into ADPCM data. The music data to be stored in the hard disk drive 5 is captured through the communication network 80. It will be apparent to those skilled in the art that the music data may also be captured from a floppy disk or a compact disk into the hard disk by means of the disk drive 20.

The communication interface 6 reproduces the music data coming through the communication network 80 in an original form according to protocol by which the music data is transmitted, and outputs the reproduced music data to the hard disk drive 5. The communication interface 6 sends a history record and so on stored in the hard disk drive 5 to the host computer 90 according to the protocol.

The tone generator 7 is capable of simultaneously generating music tone signals by use of a plurality of channels. The tone generator 7 receives music data complying with the MIDI standard through the address/data bus 18, generates the music tone signal from the received data, and outputs the tone signal to a mixer 9. The tone generator 7 is constructed for simultaneously vocalizing musical tone signals through the plurality of channels. For example, the tone generator 7 forms a plurality of vocalizing channels by use of one synthesizing circuit in a time division manner. Alternatively, the tone generator 7 has a constitution in which one vocalizing channel is made up of one synthesizing circuit. The tone generator 7 can use any tone signal synthesis scheme. For example, the tone generator 7 can use any of the memory reading method (wave table method) in which tone waveform sample values stored in a waveform memory is read out sequentially according to address data that changes depending on a pitch of a music tone to be generated, the FM method in which predetermined frequency modulation arithmetic operation is performed with the above-mentioned address data used as a phase angle parameter to obtain tone waveform sample values, and the AM method in which predetermined amplitude modulation arithmetic operation is performed with the above-mentioned address data used as a phase angle parameter to obtain tone waveform sample values. In addition to these methods, the tone generator 7 can use any of the physical model method in which a tone waveform is synthesized by an algorithm simulating the vocalization principle of an acoustic musical instrument, the harmonics synthesizing method in which a tone waveform is synthesized by adding a plurality of harmonics to a basic waveform, the formant synthesizing method in which a tone waveform is synthesized by use of a formant waveform having a particular spectral distribution, and the analog synthesis method in which VCO, VCF, and VCA are used. The tone generator 7 may be constituted by not only dedicated hardware but also a DSP and a microprogram or a CPU and a software program.

The ADPCM decoder 8 decompresses ADPCM data included in the music data read from the hard disk drive 5 by bit-converting and frequency-converting the ADPCM data to generate the original vocal signal. It should be noted that the ADPCM decoder 8 may also generate a vocal signal pitch-shifted according to pitch interval information.

The harmony generator 19 is assigned with at least one channel of MIDI. The harmony generator 19 receives pitch shift data representing a pitch difference between a pitch of a main melody line to be sung by a karaoke player and a pitch of a chorus melody line for attaching a harmony chorus to a singing voice. Based on the received pitch shift data, the harmony generator 19 shifts the pitch of the singing voice outputted from a microphone 10 to generate chorus tones of a plurality of harmony melody parts, and outputs the generated chorus tones to the mixer 9 along with the singing voice.

Figure 8:
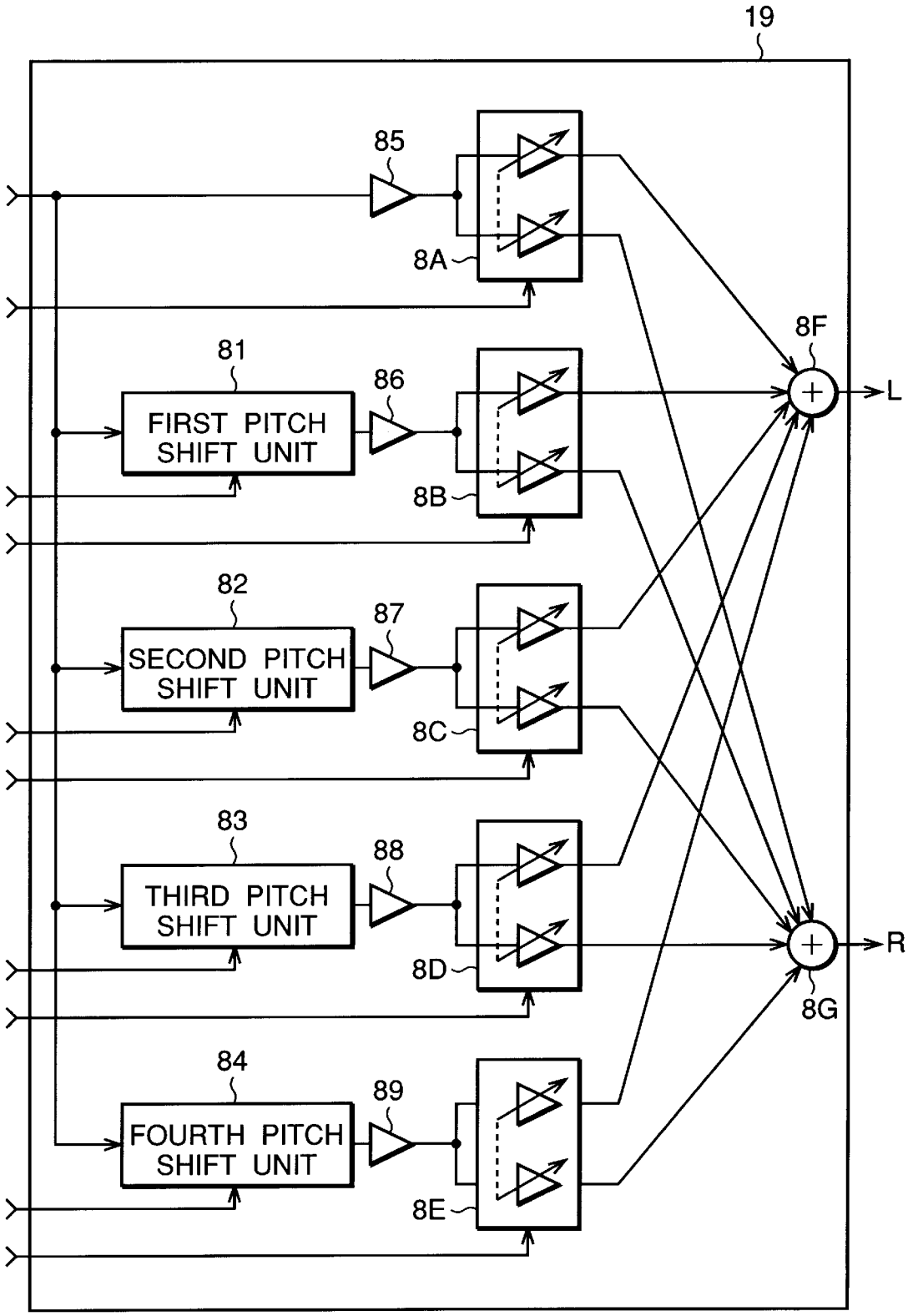
FIG. 8 is a diagram illustrating a detailed constitution of a harmony generator included in the karaoke apparatus of FIG. 4.

FIG. 8 shows a detailed constitution of the harmony generator 19. As seen from the figure, the harmony generator 19 comprises four pitch shift units 81 through 84 which correspond to sub-channels in one channel assigned to the harmony generator 19. Each of the four pitch shift units 81 through 84 is provided for generating a chorus tone of each harmony melody part. The harmony generator 19 further comprises a volume 85 for controlling a volume of the singing voice of a karaoke player, volumes 86 through 89 for controlling a volume of the chorus tones of the harmony melody parts, a pan controller 8A for controlling panning of the singing voice, pan controllers 8B through 8E for controlling panning of the chorus tones of the harmony melody parts, a left-channel adder 8F, and a right-channel adder 8G. The pitch shift units 81 through 84 capture pitch shift data outputted from a sequencer constituted by a software module controlled by the CPU, and shift the pitch of the singing voice based on the captured pitch shift data.

Referring back to FIG. 4, the mixer 9 mixes a tone signal from the tone generator 7, a singing voice signal from the microphone 10, and chorus tone signals of a plurality of harmony melody parts outputted from the harmony generator 19 by pitch-shifting the singing voice. The mixer 9 outputs the resultant signal to the effector 11.

The effector 11 imparts effects such as echo, reverberation, and pitch bend to the tone signal and the voice signal outputted from the mixer 9, performs localization control on these signals, and outputs the resultant signal to an acoustic output unit 12. It should be noted that, since localization of each harmony melody part is controlled inside the harmony generator 19, the effector 11 controls the localization of the harmony melody parts totally. It will be apparent that the localization control may be performed in the effector 11 at the succeeding stage rather than in the harmony generator 19 at the preceding stage. The effector 11 controls the kind and depth or degree of an effect according to control information arranged on an effect control track in the music data. The acoustic output unit 12 vocalizes the tone signal and the voice signal outputted from the effector 11 through a sound system composed of an amplifier and a loudspeaker.

The graphics generator 13 generates a song words image to be displayed on a monitor screen based on a character code generated based on MIDI data recorded on a words track. The MIDI data includes a character data associated with the display location of words, display duration data associated with the duration of time in which words are displayed, and color wipe control data for sequentially changing display colors of the words as the karaoke music progresses. The background video generator 15 selectively reproduces a predetermined background image corresponding to the genre of the karaoke music from a CD-ROM 14, and outputs the reproduced background image to an image mixer 16. The image mixer 16 superimposes the words image outputted from the graphic generator 13 onto the background image outputted from the background video generator 15, and outputs the resultant image to an image output circuit 17. The image output circuit 17 displays on the monitor screen a composite image of the background image and the words image mixed together by the image mixer 16.

FIGS. 5(A) and 5(B) show an example of format of music data for one piece of karaoke music received by the karaoke apparatus 70 through the communication network 80. It should be noted that the received music data is saved in the hard disk drive 5. The music data is composed of a header section 31, a MIDI data section 32, and a voice data section 33 as shown in FIG. 5(A).

The header section 31 is made up of bibliographical data associated with the karaoke music, the bibliographical data being composed of a music title, a music genre, a date of release, a performance duration, and chorus mode information. The chorus mode information is data associated with chorus tone vocalization, and includes data that indicates whether the karaoke music is compatible with a chorus mode and data that indicates the kind of chorus. In addition, the header section 31 may record auxiliary information such as time stamps indicating the dates on which the karaoke music was delivered and accessed, and the number of times the music concerned was accessed.

The MIDI data section 32 is composed of a tone track, a words track, a voice track, and an effect control track. The tone track records performance data of a main melody part, an accompaniment part, and a rhythm part corresponding to the karaoke music. If the karaoke music is adapted to the chorus mode, the tone track records data of a chorus melody part in parallel to the main melody part of the karaoke music. The performance data, complying with the MIDI standard, includes duration time data Δt indicating a time interval between note events, status data indicating types of these events in terms of a vocalization start command, vocalization stop command and so on, pitch designation data for designating a pitch at which vocalization starts or stops, and volume designation data for designating a volume at vocalization. The volume designation data is added when the status data indicates the vocalization start command.

The words track records data associated with the words to be displayed on the monitor screen in a system exclusive message format of MIDI. To be more specific, the MIDI data to be recorded on this words track includes character data indicating a character code corresponding to the words to be displayed and the display location thereof, display duration data associated with the duration of time in which the words are displayed, and color wipe control data for sequentially changing the displayed words colors as the music progresses.

Figure 5:
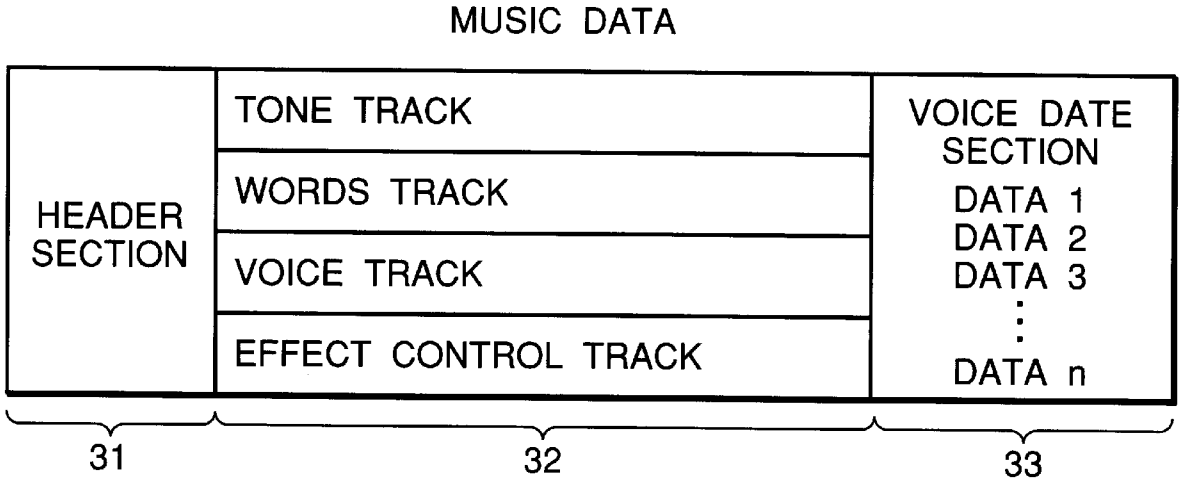
FIGS. 5(A) and 5(B) are a diagram illustrating an example of music data for one piece of karaoke music stored in a hard disk contained in the karaoke apparatus of FIG. 4.
Figure 5:
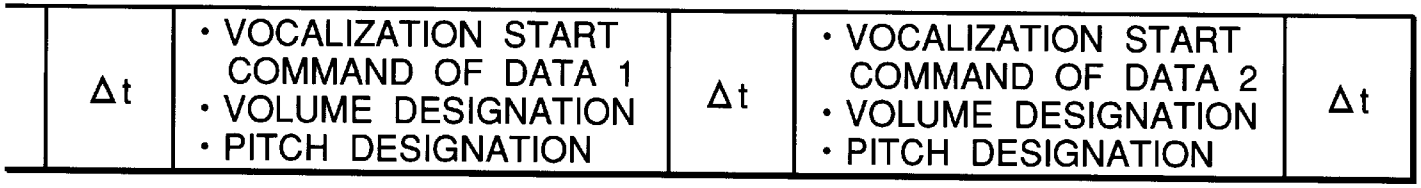

The voice track records control data associated with generation of voice waveform data recorded on the voice data section in the system exclusive message format of MIDI as shown in FIG. 5(B). To be more specific, the MIDI data recorded on this voice track is composed of duration data Δt indicating the generation timing of the voice waveform data, event data indicating a first vocalization start command of waveform data 1, event data indicating a second vocalization start command of waveform data 2, and so on. The event data includes data for designating the voice waveform data to be vocalized in a specified timing and data for designating the volume and pitch of the voice. The effect control track records the MIDI data associated with the control of the effector 11. The words track and the effect control track are transmitted from the host computer 90 as data complying with the MIDI standard as shown in FIG. 5 (B), and are stored in the hard disk drive 5.

Figure 6:
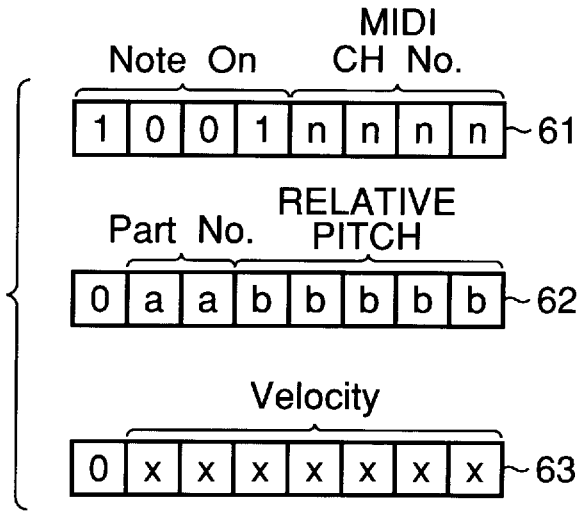
FIG. 6 is a diagram illustrating an example of a note-on message in MIDI data format associated with a chorus melody part.
Figure 7:
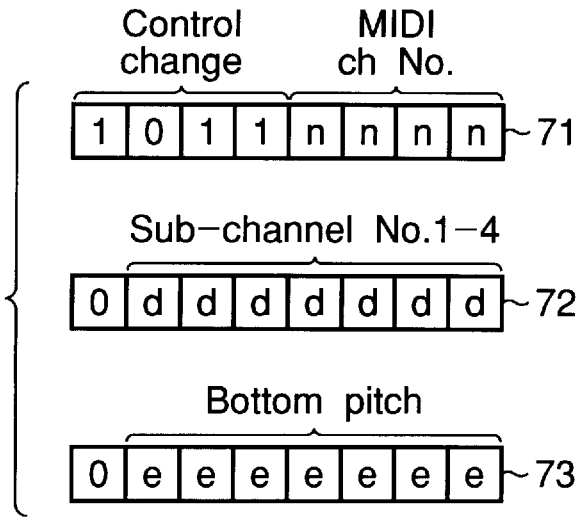
FIG. 7 is a diagram illustrating an example of a control change message in MIDI data format associated with a chorus melody part.

FIGS. 6 and 7 show an example of format of the MIDI data associated with the chorus. FIG. 6 shows an example of data format of a note-on message included in the MIDI data. FIG. 7 shows an example of data format of a control change message included in the MIDI data. In this MIDI data, the chorus is composed of four parallel harmony melody parts denoted by first part PART1 through fourth part PART4.

As seen from FIG. 6, the note-on message is composed of a status byte 61 in which most significant bit (identification bit) is "1", and two data bytes 62 and 63 in which most significant bits are "0"s. The status byte is generally the same as that of ordinary MIDI data such that the low-order four bits "nnnn" indicates a MIDI channel number while the highorder four bits indicates a voice message type. The status byte 61 shown in FIG. 6 is "9nH" in hexadecimal notation because this is the voice message of note-on. The data byte 62 indicates one of 32 pitches in the unit of semitone by the low-order five bits "bbbbb", and indicates by the sixth and seventh bits "aa" from the right end, which of the harmony melody parts this MIDI message belongs to. If the bits "aa" are "11", it indicates the first part PART1; if the bits "aa" are "10", it indicates the second part PART2; if the bits "aa" are "01", it indicates the third part PART3; and if the bits "aa" are "00", it indicates the fourth part PART4.

Figure 1:
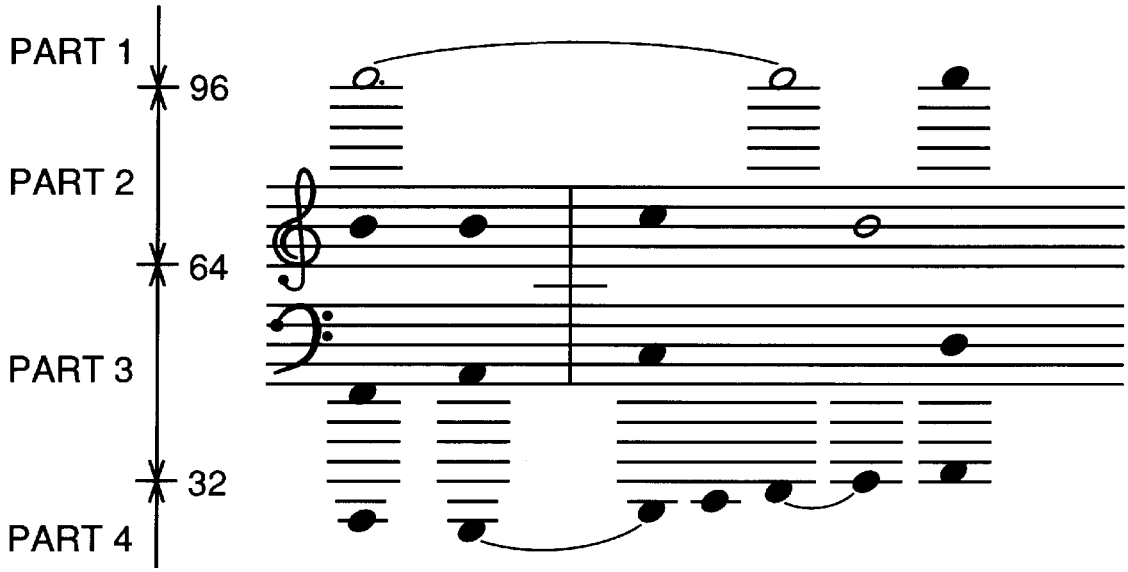
FIG. 1 is a diagram illustrating a music score indicating by way of example how notes in each part are converted by a music apparatus associated with the present invention.

Consequently, if the note-on message is associated with the first part PART1, the data byte 62 is "011bbbbb"; if the note-on message is associated with the second part PART2, the data byte 62 is "010bbbbb"; if the note-on message is associated with the third part PART3, the data byte 62 is "001bbbbb"; and if the note-on message is associated with the fourth part PART4, the data byte 62 is "000bbbbb". As shown in FIG. 1, the absolute pitch of a chorus tone of the first part PART1 ranges in note numbers "96" to "127", the absolute pitch of a chorus tone of the second part PART2 ranges in note numbers "64" to "95", the absolute pitch of a chorus tone of the third part PART3 ranges in note numbers "32" to "63", and the absolute pitch of a chorus tone of the fourth part PART4 ranges in note numbers "00" to "31". The data byte 63 is generally the same as ordinary MIDI data, and indicates by the low-order seven bits "xxxxxxx" the velocity of a chorus tone corresponding to the note-on.

As seen from FIG. 7, the control change message is composed of a status byte 71 in which most significant bit (identification bit) is "1", and two data bytes 72 and 73 in which most significant bits (identification bits) are "0"s. The status byte 71 is generally the same as that of ordinary MIDI message, the low-order four bits "nnnn" indicating a MIDI channel while the high-order four bits indicating a voice message type. In the present preferred embodiment, the status byte 71 of FIG. 7 is "BnH" because this is control change of the voice message.

If the voice message is for control change, the first data byte 72 ordinarily indicates its control number. In the present embodiment, however, the low-order seven bits "ddddddd" of the data byte 72 indicates to which of the harmony melody parts the control change message belongs. Namely, the present preferred embodiment uses a control number which is ordinarily not used. For example, if "0ddddddd" of the data byte 72 is "00100111" in binary notation or "27H" in hexadecimal notation, it indicates the control change message associated with the bottom pitch of the first part PART1; if "0ddddddd" of the data byte 72 is "00101000" or "28H" in hexadecimal notation, it indicates the control change message associated with the bottom pitch of the second part PART2; if "0ddddddd" of the data byte 72 is "00101000" or "29H" in hexadecimal notation, it indicates the control change message associated with the bottom pitch of the third part PART3; and if "0ddddddd" of the data byte 72 is "00101001" or "2AH" in hexadecimal notation, it indicates the control change message associated with the bottom pitch of the fourth part PART4.

If "0ddddddd" of the data byte 72 is "01010101" or "55H" in hexadecimal notation, it indicates the control change message associated with setting of the pitch bend range of the first part PART1; if "0ddddddd" of the data byte 72 is "01010110" or "56H" in hexadecimal notation, it indicates the control change message associated with setting of the pitch bend range of the second part PART2; if "0ddddddd" of the data byte 72 is "01010111" or "57H" in hexadecimal notation, it indicates the control change message associated with setting of the pitch bend range of the third part PART3; and if "0ddddddd" of the data byte 72 is "01011000" or "58H" in hexadecimal notation, it indicates the control change message associated with setting of the pitch bend range of the fourth part PART4. The data byte 73 individually indicates, by the low-order seven bits "eeeeeee", the bottom pitches or pitch bend ranges of the first part PART1 through the fourth part PART4 designated by the preceding data byte 72.

Figure 2:
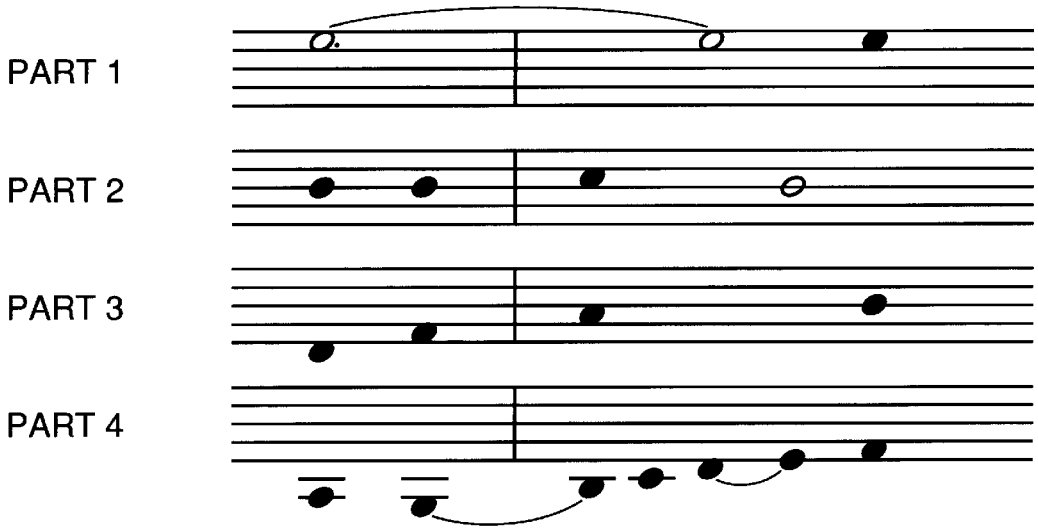
FIG. 2 is a diagram illustrating a music score indicating an example of chorus tones of four melody parts in order to explain an example of operations of the present invention.
Figure 3:
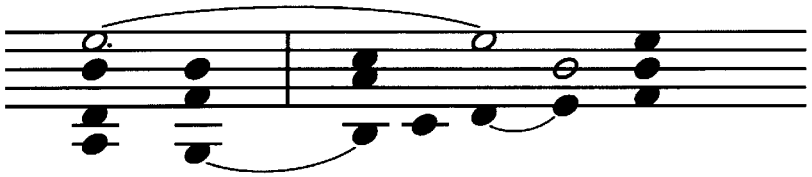
FIG.3 PRIOR ART
FIG. 3 is a diagram illustrating an example of operations of related-art technology.

The following describes the pitch conversion of the chorus tone by way of the examples shown in FIGS. 1 and 2. For the chorus of the four parallel melody parts (the first part PART1 through the fourth part PART4), the CPU 1 decodes the MIDI message supplied in advance and, based on the decoding result, controls the karaoke apparatus to concurrently generate chorus tones.

First, the CPU 1 decodes the control change message having the data byte 72 of "27H", "28H", "29H", and "2AH" and, based on the data byte 73, sets the bottom pitches of the respective melody parts. The contents of the data byte 73 are as follows:

the bottom pitch of the third part: note number "76", note name "E5";

the bottom pitch of the second part: note number "64", note name "E4"; the bottom pitch of the fourth part: note number "53", note name "F3"; and the bottom pitch of the first part: note number "36", note name "C2".

These are represented in a 8-bit format as follows:

the bottom pitch of the first part: note number "76"= "01001100";

the bottom pitch of the second part: note number "64"= "01000000";

the bottom pitch of the third part: note number "53"= "00110101"; and the bottom pitch of the fourth part: note number "36"= "00100100".

Next, the CPU 1 obtains the note-on message that indicates a pitch difference of each tone or note relative to the bottom pitch set as a reference in each part. As described before, the note-on message is composed of three bytes 61, 62, and 63 shown in FIG. 6. For the first part PART1, "aa" is "11". As shown in FIG. 2, the first tone and the second tone of the first PART1 are the tones of nominal note number "76"="01001100" and the note name "E5", and the pitch difference with the bottom pitch is "0". Therefore, "bbbbb" of the byte 62 is "00000". The data byte 62 has nominal value of "76"="01100000". When the nominal pitch indicated by the data byte 62 is written in an ordinary music score, the notes belonging to the first part PART1 are obtained in the absolute range of actual note numbers "96" through "127".

By such a manner, the MIDI messages associated with the first part PART1 are formulated. Of these messages, the note number "76"="01001100" of the bottom pitch is determined by the control change message. By adding the low-order five bits of "01100000" of the data byte 62 included in the note-on message to this reference note number, the absolute pitch can be obtained. In this case, the low-order five bits are "00000", so that the note number "76"="01001100" of the bottom pitch becomes the first nominal pitch of the first note belonging to the first part PART1. The nominal pitch "76" shown in FIG. 2 actually corresponds to the absolute pitch "96" shown in FIG. 1.

The CPU 1 finds a pitch shift between the chorus pitch of the first part PART1 thus obtained and the melody pitch of the main melody part, and outputs the obtained pitch shift amount to the first pitch shift unit 81 in the harmony generator 19 as first pitch shift data. Based on this first pitch shift data, the first pitch shift unit 81 shifts the pitch of the singing voice inputted from the microphone 10. The first pitch shift unit 81 outputs the shifted pitch voice to the mixer 9 through the pan control unit 8B, the left-channel adder 8F, and the right-channel adder 8G.

The following describes the pitch conversion in the second part PART2. In the second part PART2, "aa" included in the second byte 62 of the note-on message is "10". As shown in FIG. 2, the first, second, and fourth tones have a nominal note number "71"="01000111" and nominal note name "B4", and the pitch difference with the bottom pitch is "7". Therefore, for the first, second, and fourth tones, the low-order five bits of the data byte 62 is "00111". For the third tone, the nominal note number "72"="01001000", the nominal note name is "C5", and the pitch difference with the bottom pitch is "8". For the third tone, "bbbbb" is "0100". When the pitch of the tone indicated by this data byte 62 is transformed on an ordinary music score, the actual notes belonging to the second part PART2 are obtained in the absolute range of note numbers "64" through "95".

At the time the note-on message of the second part PART2 is provided, the note number "64"="01000000" of the bottom pitch is already determined by the control change message of the corresponding part PART2. Therefore, for the first, second, and fourth tones of PART2, by adding the low-order five bits "00111" of the seven bits "01000111" of the data byte 62 to the data of the bottom pitch, the nominal pitch "71"="01000111" of the first, second, and fourth tones can be obtained. For the third tone, by adding the low-order five bits "01000" of the seven bits "01001000" of the data byte 62 to the data of the bottom pitch, the nominal pitch "72"="01001000" is obtained. It should be noted that, for the second part PART2, the actual notation of the music score shown in FIG. 1 is generally the same as the nominal notation of the music score shown in FIG. 1. This is because the contents "01000000" of the data byte 62 with the relative pitch being "0" are the same as the actual pitch "64".

The CPU 1 outputs the second pitch shift amount data between the pitch of the second part PART2 and the pitch of the main melody part to the second pitch shift unit 82 in the harmony generator 19. Based on this second pitch shift amount data, the second pitch shift unit 82 shifts the pitch of the singing voice inputted from the microphone 10, and outputs the shifted pitch voice to the mixer 9 through the volume 87, the pan controller 8C, the left-channel adder 8F, and the right-channel adder 8G.

For the tones of the third part PART3 and the fourth part PART4, the absolute pitch is obtained in generally the same manner based on the data byte 62 indicating the pitch difference between the absolute pitch and the bottom or reference pitch included in the control change message. The third and fourth pitch shift amount data between the obtained pitches of the third part PART3 and the fourth part PART4, and the pitch of the main melody part are, respectively, outputted to the third pitch shift unit 83 and the fourth pitch shift unit 84 in the harmony generator 19. Based on the third pitch shift amount data, the third pitch shift unit 83 shifts the pitch of the singing voice inputted from the microphone 10, and outputs the shifted pitch voice to the mixer 9 through the volume 88, the pan controller 8D, the left-channel adder 8F, and the right-channel adder 8G. Likewise, based on the fourth pitch shift amount data, the fourth pitch shift unit 84 shifts the pitch of the singing voice inputted from the microphone 10, and outputs the shifted pitch voice to the mixer 9 through the volume 89, the pan controller 8E, the left-channel adder 8F, and the right-channel adder 8G.

To attach a pitch bend to the parts independently from each other, a control change number "01010101"="55H", "01010110"="56H", "01010111"="57H" or "01011000"="58H" is set to the second data byte 72 of the control change message. A desired pitch bend amount can be set by the third data byte 73 of the control change message. Consequently, the pitch bends of the tones belonging to the first part PART1 through the fourth part PART4 can be controlled separately from each other. If an effect other than the pitch bend is imparted to one of the multiple parts or localization control is performed thereon, a reserved control change number may be assigned to each part. In this way, a desired effect can be attached to each part separately and localization control can be performed on each part separately.

Referring back again to FIGS. 4 and 8, in the inventive music apparatus, a generator device in the form of the tone generator 7 and the harmony generator 19 has a plurality of channels for concurrently generating various tones. At least one channel is assigned to the harmony generator 19 to generate chorus tones belonging to a multiple of melody parts denoted by PARTs 1 to 4 arranged in parallel to each other. A provider device in the form of the HDD 5, the disk drive 20 or the host computer 90 provides music messages assigned to the plurality of the channels to generate the various tones. The music messages includes a particular music message being assigned to said one channel and being composed of a first music message which contains a note and identifies a melody part to which the note belongs, and a second music message which contains a parameter and identifies a melody part to which the parameter belongs. A controller device in the form of the CPU 1 controls said one channel of the generator device according to the note and the parameter both belonging to the same melody part so as to generate the chorus tone such that said one channel can generate one chorus tone belonging to one melody part independently from another chorus tone belonging to another melody part.

The inventive music apparatus further comprises a pickup device in the form of the microphone 10 that collects a live singing voice, and a mixer device in the form of the mixer 9 that mixes the collected live singing voice to the various tones which are concurrently generated by the generator device to constitute a karaoke music to accompany the live singing voice. The karaoke music contains the chorus tones of the multiple of the melody parts to provide a synthetic back chorus voice to the live singing voice.

The provider device provides the particular music message formed according to MIDI standard such that the first music message comprises an extended MIDI note message which is modified to specify the melody part as a sub-channel of said one channel, and the second music message comprises an extended MIDI control message which is also modified to specify the melody part as a sub-channel of said one channel. As mentioned before, said one channel is allotted to the harmony generator 19, and the four sub-channels of said one channel are allotted to the first to fourth pitch shift units 81 through 84. The provider device provides the first message shown in FIG. 6 containing the note which specifies a relative pitch of the chorus tone with respect to a reference pitch determined to conform with a pitch range of the identified melody part, and provides the second music message shown in FIG. 7 containing the parameter which specifies the reference pitch of the identified melody part. The controller device calculates an absolute pitch of the chorus tone according to the relative pitch and the reference pitch so as to enable said one channel to generate the chorus tone at the absolute pitch within the pitch range of the identified melody part. The provider device provides the second music message containing the parameter which specifies an acoustic effect including at least one of panning the chorus tone and pitch bending the chorus tone. The controller device applies the acoustic effect to the chorus tone of the identified melody part independently from the other chorus tones of the other melody parts.

The inventive method concurrently generates various tones through a plurality of channels. At least one channel is assigned to generate chorus tones belonging to a multiple of melody parts arranged in parallel to each other. The inventive method is carried out according to the following steps. The first step is providing music messages assigned to the plurality of the channels to generate the various tones. The music messages includes a particular music message being assigned to said one channel and being composed of a first music message shown in FIG. 6 which contains pitch information (byte 62, bits bbbbb) of a chorus tone and part information (also byte 62, bits aa) identifying a melody part to which the chorus tone belongs, and a second music message shown in FIG. 7 which contains control information (byte 73)of a chorus tone and part information (byte 72) identifying a melody part to which the control information belongs. The second step is combining the pitch information and the control information both belonging to the same melody part according to the part information of the first music message and the part information of the second music message. The third step is activating said one channel according to the combined pitch information and the control information both belonging to the same melody part so as to generate the chorus tone such that said one channel can generate one chorus tone belonging to one melody part independently from another chorus tone belonging to another melody part.

The step of providing provides the particular music message formed according to MIDI standard such that the first music message comprises an extended MIDI note message which is modified to specify the melody part as a sub-channel of said one channel, and such that the second music message comprises an extended MIDI control message which is also modified to specify the melody part as a sub-channel of said one channel. The step of providing provides the first message containing the pitch information (byte 62, bits bbbbb) which specifies a relative pitch of the chorus tone with respect to a reference pitch determined to conform with a pitch range of the identified melody part, and provides the second music message containing the control information (byte 73, bits eeeeeee) which specifies the reference pitch of the identified melody part. The step of activating calculates an absolute pitch of the chorus tone according to the relative pitch and the reference pitch so as to enable said one channel to generate the chorus tone at the absolute pitch within the pitch range of the identified melody part.

The machine readable media 21 contains music messages for causing a music machine in the form of the karaoke apparatus 70 to perform operation of concurrently generating various tones through a plurality of channels, at least one channel being assigned to generate chorus tones belonging to a multiple of melody parts arranged in parallel to each other. The operation is carried out according to the steps of providing music messages assigned to the plurality of the channels to generate the various tones, the music messages including a particular music message being assigned to said one channel and being composed of a first music message which contains pitch information of a chorus tone and part information identifying a melody part to which the chorus tone belongs, and a second music message which contains control information of a chorus tone and part information identifying a melody part to which the control information belongs, combining the pitch information and the control information both belonging to the same melody part according to the part information of the first music message and the part information of the second music message, and activating said one channel according to the combined pitch information and the control information both belonging to the same melody part so as to generate the chorus tone such that said one channel can generate one chorus tone belonging to one melody part independently from another chorus tone belonging to another melody part.

The invention further covers a reproducing apparatus connectable to an external provider device such as the host computer 90 for concurrently reproducing various tones through a plurality of channels, at least one channel being assigned to generate chorus tones belonging to a multiple of melody parts arranged in parallel to each other. The reproducing apparatus comprises receiving means such as the communication interface 6 for receiving music messages assigned to the plurality of the channels to reproduce the various tones, the music messages including a particular music message being assigned to said one channel and being composed of a first music message which contains pitch information of a chorus tone and part information identifying a melody part to which the chorus tone belongs, and a second music message which contains control information of a chorus tone and part information identifying a melody part to which the control information belongs, combining means in the form of the CPU 1 for combining the pitch information and the control information both belonging to the same melody part according to the part information of the first music message and the part information of the second music message, and activating means in the form of the harmony generator 19 for activating said one channel according to the combined pitch information and the control information both belonging to the same melody part so as to generate the chorus tone such that said one channel can generate one chorus tone belonging to one melody part concurrently with and independently from another chorus tone belonging to another melody part.

As described and according to the invention, localization (pan pot) control can be separately performed on each of a plurality of chorus melody parts and an effect can be separately attached thereto without increasing undue occupancy of MIDI channels. Further, the harmonic chorus voice, which is conventionally monaural, can be controlled stereophonically in synchronization with the karaoke music.

While the preferred embodiment of the present invention has been described using specific terms, such description is for illustrative purposes only, and it is to be understood that changes and variations may be made without departing from the spirit or scope of the appended claims.

What is claimed is:

1. A music apparatus comprising:

a generator device that has a plurality of channels for concurrently generating various tones, at least one channel being assigned to generate chorus tones belonging to a multiple of melody parts arranged in parallel to each other;

a provider device that provides music messages assigned to the plurality of the channels to generate the various tones, the music messages including a particular music message being assigned to said one channel and being composed of a first music message which contains a note and identifies a melody part to which the note belongs, and a second music message which contains a parameter and identifies a melody part to which the parameter belongs; and a controller device that controls said one channel of the generator device according to the note and the parameter both belonging to the same melody part so as to generate the chorus tone such that said one channel can generate one chorus tone belonging to one melody part independently from another chorus tone belonging to another melody part.

2. A music apparatus according to claim 1, further comprising a pickup device that collects a live singing voice, and a mixer device that mixes the collected live singing voice to the various tones which are concurrently generated by the generator device to constitute a karaoke music to accompany the live singing voice, the karaoke music containing the chorus tones of the multiple of the melody parts to provide a synthetic back chorus voice to the live singing voice.

3. A music apparatus according to claim 1, wherein the provider device provides the particular music message formed according to MIDI standard such that the first music message comprises an extended MIDI note message which is modified to specify the melody part as a sub-channel of said one channel, and the second music message comprises an extended MIDI control message which is also modified to specify the melody part as a sub-channel of said one channel.

4. A music apparatus according to claim 1, wherein the provider device provides the first message containing the note which specifies a relative pitch of the chorus tone with respect to a reference pitch determined to conform with a pitch range of the identified melody part, and provides the second music message containing the parameter which specifies the reference pitch of the identified melody part, and wherein the controller device calculates an absolute pitch of the chorus tone according to the relative pitch and the reference pitch so as to enable said one channel to generate the chorus tone at the absolute pitch within the pitch range of the identified melody part.

5. A music apparatus according to claim 1, wherein the provider device provides the second music message containing the parameter which specifies an acoustic effect including at least one of panning the chorus tone and pitch-bending the chorus tone, and wherein the controller device applies the acoustic effect to the chorus tone of the identified melody part independently from the other chorus tones of the other melody parts.

6. A method of concurrently generating various tones through a plurality of channels, at least one channel being assigned to generate chorus tones belonging to a multiple of melody parts arranged in parallel to each other, the method comprising the steps of;

providing music messages assigned to the plurality of the channels to generate the various tones, the music messages including a particular music message being assigned to said one channel and being composed of a first music message which contains pitch information of a chorus tone and part information identifying a melody part to which the chorus tone belongs, and a second music message which contains control information of a chorus tone and part information identifying a melody part to which the control information belongs;

combining the pitch information and the control information both belonging to the same melody part according to the part information of the first music message and the part information of the second music message; and activating said one channel according to the combined pitch information and the control information both belonging to the same melody part so as to generate the chorus tone such that said one channel can generate one chorus tone belonging to one melody part independently from another chorus tone belonging to another melody part.

7. A method according to claim 6, wherein the step of providing provides the particular music message formed according to MIDI standard such that the first music message comprises an extended MIDI note message which is modified to specify the melody part as a sub-channel of said one channel, and such that the second music message comprises an extended MIDI control message which is also modified to specify the melody part as a sub-channel of said one channel.

8. A method according to claim 6, wherein the step of providing provides the first message containing the pitch information which specifies a relative pitch of the chorus tone with respect to a reference pitch determined to conform with a pitch range of the identified melody part, and provides the second music message containing the control information which specifies the reference pitch of the identified melody part, and wherein the step of activating calculates an absolute pitch of the chorus tone according to the relative pitch and the reference pitch so as to enable said one channel to generate the chorus tone at the absolute pitch within the pitch range of the identified melody part.

9. A machine readable media containing music messages for causing a music machine to perform operation of concurrently generating various tones through a plurality of channels, at least one channel being assigned to generate chorus tones belonging to a multiple of melody parts arranged in parallel to each other, wherein the operation comprises the steps of;

providing music messages assigned to the plurality of the channels to generate the various tones, the music messages including a particular music message being assigned to said one channel and being composed of a first music message which contains pitch information of a chorus tone and part information identifying a melody part to which the chorus tone belongs, and a second music message which contains control information of a chorus tone and part information identifying a melody part to which the control information belongs;

combining the pitch information and the control information both belonging to the same melody part according to the part information of the first music message and the part information of the second music message; and activating said one channel according to the combined pitch information and the control information both belonging to the same melody part so as to generate the chorus tone such that said one channel can generate one chorus tone belonging to one melody part independently from another chorus tone belonging to another melody part.

10. A machine readable media according to claim 9, wherein the step of providing provides the particular music message formed according to MIDI standard such that the first music message comprises an extended MIDI note message which is modified to specify the melody part as a sub-channel of said one channel, and such that the second music message comprises an extended MIDI control message which is also modified to specify the melody part as a sub-channel of said one channel.

11. A machine readable media according to claim 9, wherein the step of providing provides the first message containing the pitch information which specifies a relative pitch of the chorus tone with respect to a reference pitch determined to conform with a pitch range of the identified melody part, and provides the second music message containing the control information which specifies the reference pitch of the identified melody part, and wherein the step of activating calculates an absolute pitch of the chorus tone according to the relative pitch and the reference pitch so as to enable said one channel to generate the chorus tone at the absolute pitch within the pitch range of the identified melody part.

12. A reproducing apparatus for concurrently reproducing various tones through a plurality of channels, at least one channel being assigned to generate chorus tones belonging to a multiple of melody parts arranged in parallel to each other, the apparatus comprising;

receiving means for receiving music messages assigned to the plurality of the channels to reproduce the various tones, the music messages including a particular music message being assigned to said one channel and being composed of a first music message which contains pitch information of a chorus tone and part information identifying a melody part to which the chorus tone belongs, and a second music message which contains control information of a chorus tone and part information identifying a melody part to which the control information belongs;

combining means for combining the pitch information and the control information both belonging to the same melody part according to the part information of the first music message and the part information of the second music message; and activating means for activating said one channel according to the combined pitch information and the control information both belonging to the same melody part so as to generate the chorus tone such that said one channel can generate one chorus tone belonging to one melody part independently from another chorus tone belonging to another melody part.

13. A reproducing apparatus according to claim 12, wherein the receiving means receives the particular music message formed according to MIDI standard such that the first music message comprises an extended MIDI note message which is modified to specify the melody part as a sub-channel of said one channel, and such that the second music message comprises an extended MIDI control message which is also modified to specify the melody part as a sub-channel of said one channel.

14. A reproducing apparatus according to claim 12, wherein the receiving means receives the first music message containing the pitch information which specifies a relative pitch of the chorus tone with respect to a reference pitch determined to conform with a pitch range of the identified melody part, and receives the second music message containing the control information which specifies the reference pitch of the identified melody part, and wherein the activating means calculates an absolute pitch of the chorus tone according to the relative pitch and the reference pitch so as to enable said one channel to generate the chorus tone at the absolute pitch within the pitch range of the identified melody part.

* * * * *